US007398619B2

(12) United States Patent
Chang

(10) Patent No.: US 7,398,619 B2
(45) Date of Patent: Jul. 15, 2008

(54) FORT

(76) Inventor: Min-Hsien Chang, 1, Ne-Won Village, Fan Ru Shiang, Chia Yi Hsien (TW)

( * ) Notice: Subject to any disclaimer, the term of this patent is extended or adjusted under 35 U.S.C. 154(b) by 461 days.

(21) Appl. No.: 11/174,672

(22) Filed: Jul. 6, 2005

(65) Prior Publication Data

US 2007/0000189 A1 Jan. 4, 2007

(51) Int. Cl.
*E04B 1/32* (2006.01)
*F41H 13/00* (2006.01)

(52) U.S. Cl. ..... 52/80.1; 89/36.07

(58) Field of Classification Search ..... 52/169.6, 52/80.1, 82, 72, 200, 167.1, 3; 135/901, 135/902; 43/1; 89/36.04, 36.07
See application file for complete search history.

(56) References Cited

U.S. PATENT DOCUMENTS 475,844 A * 5/1892 Bayha ..... 105/394
1,314,466 A * 8/1919 Campbell ..... 89/36.04
1,347,652 A * 7/1920 Swan ..... 109/9
2,792,794 A * 5/1957 Miller ..... 52/66
2,992,503 A * 7/1961 Webb ..... 43/1
3,169,543 A * 2/1965 McGerty ..... 135/152
3,513,605 A * 5/1970 Smith ..... 52/20
4,364,193 A * 12/1982 Visco ..... 43/1
4,719,716 A * 1/1988 Chrisley, Jr. ..... 43/1
5,371,966 A * 12/1994 Hall ..... 43/1
5,422,164 A * 6/1995 Stanton ..... 428/182
6,481,166 B2 * 11/2002 Shelton ..... 52/167.1

* cited by examiner

*Primary Examiner*—Robert Canfield
*Assistant Examiner*—Jessie Fonseca
(74) *Attorney, Agent, or Firm*—Stites & Harbison PLLC; Marvin Petry

(57) ABSTRACT

A fort includes a defense, a top cover, and a plurality of shooting windows. The top cover is mounted on top of the defense. The top cover includes an inverted bowl-like top wall with an opening. The top cover further includes a peripheral wall extending along a periphery of the top wall. The peripheral wall includes a plurality of engaging holes. Each shooting window includes a plurality of engaging holes. A plurality of fasteners are extended through the engaging holes of each shooting window and the engaging holes of the top cover, thereby releasably mounting the shooting windows to the peripheral wall of the top cover. A safe fort that can be assembled/dismantled easily and rapidly is thus provided.

4 Claims, 2 Drawing Sheets

FORT

BACKGROUND OF THE INVENTION

1. Field of the Invention

The present invention relates to a fort. In particular, the present invention relates to a fort that can be assembled or dismantled easily.

2. Description of the Related Art

A conventional fort in a battlefield is constructed by a wall comprised of stacked sandbags or a ditch. Such a fort lacks protection in top. As a result, the soldiers in the fort are liable to be injured or even killed by grenades or fractures of cannon balls from top.

SUMMARY OF THE INVENTION

A fort in accordance with the present invention comprises a wall, a top cover, and a plurality of shooting windows. The top cover is mounted on top of the wall. The top cover comprises an inverted bowl-like top wall with an opening. The top cover further comprises a peripheral wall extending along a periphery of the top wall. The peripheral wall includes a plurality of engaging holes. Each shooting window comprises a plurality of engaging holes. A plurality of fasteners are extended through the engaging holes of each shooting window and the engaging holes of the top cover, thereby releasably mounting the shooting windows to the peripheral wall of the top cover.

A safe fort that can be assembled/dismantled easily and rapidly is thus provided.

Preferably, the peripheral wall engaging comprises a plurality of hook holes for transportation.

Preferably, the top cover is bowl shaped to allow stacking of the top cover with a similarly constructed top cover.

Preferably, each shooting window is tubular and conical to allow stacking of the shooting windows.

Preferably, each shooting window comprises a shield on an outer end of an upper side thereof for shielding from rain or the like.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
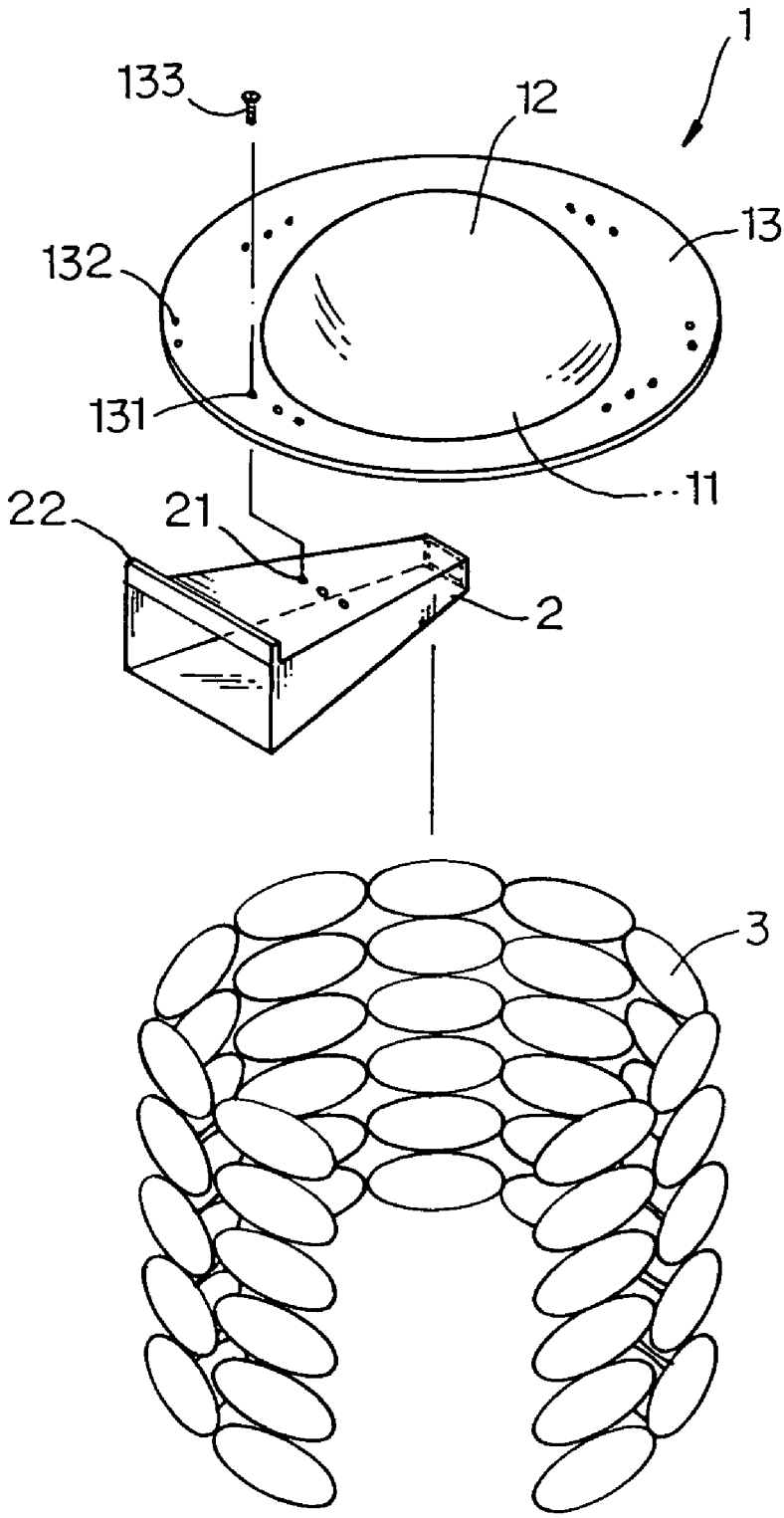
FIG. 1 is an exploded perspective view of a fort in accordance with the present invention.
Figure 3:
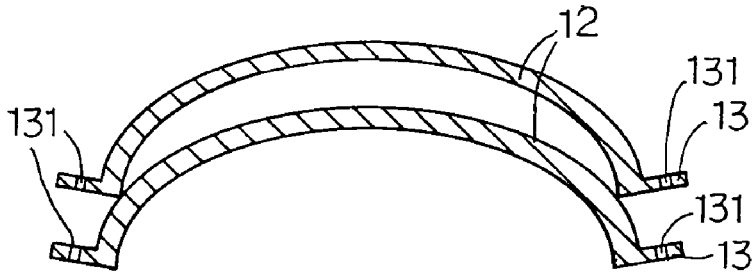
FIG. 3 is a sectional view illustrating stacking of top covers of the fort in accordance with the present invention.

Referring to FIG. 1, a fort in accordance with the present invention comprises a top cover 1, a plurality of shooting windows 2, and a wall 3. The top cover 1 includes a substantially inverted bowl-like top wall 12 with an open end 11 and a peripheral wall 13 along a peripheral of the top wall 12. A plurality of engaging holes 131 and hook holes 132 are provided on the peripheral wall 13. Ropes or hooks may be extended through the hook holes 132 to allow easy carriage or transportation. The top cover 1 is bowl shaped to allow stacking of the top wall 12 with another similarly constructed top cover 1, as shown in FIG. 3.

Figure 2:
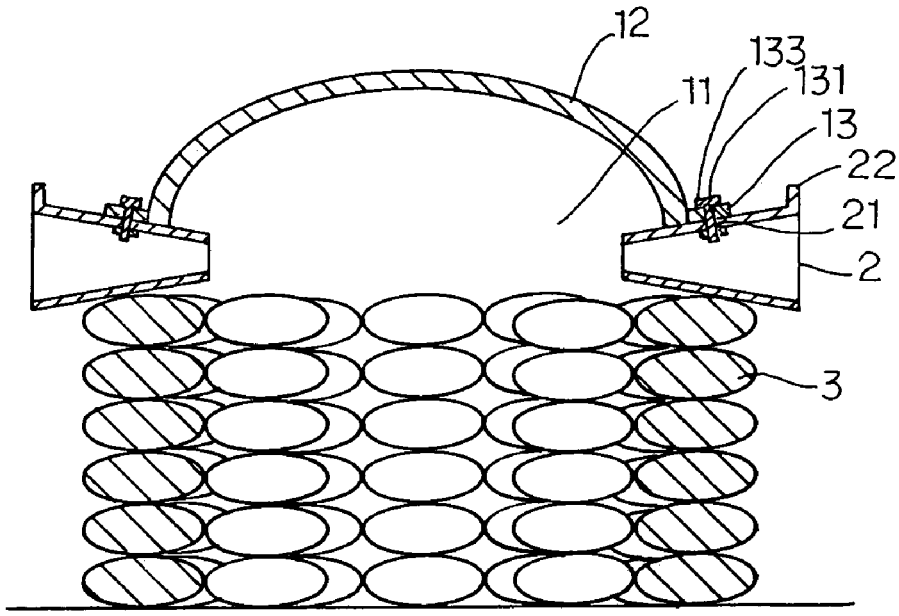
FIG. 2 is a sectional view of the fort in accordance with the present invention.
Figure 4:
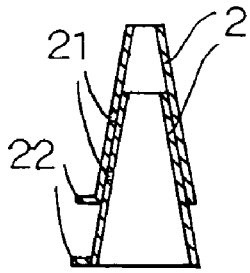
FIG. 4 is a sectional view illustrating stacking of shooting windows of the fort in accordance with the present invention.

Each shooting window 2 is a tubular conical member constructed by solid plates. The shooting window 2 can be stacked one upon another, as shown in FIG. 4. Each shooting window 2 includes a plurality of engaging holes 21. Fasteners 133 are extended through the engaging holes 131 of the top cover 1 and the engaging holes 21 of each shooting window 2. The shooting windows 2 are thus fixed to the top cover 1, best shown in FIG. 2. A shield 22 may be provided on an outer end of an upper side of each shooting window 2 for shielding from rain or the like.

The wall 3 may be constructed by sandbags or a ditch formed by excavation. The top cover 1 with the shooting windows 2 fixed thereon is mounted on top of the wall 3. Thus, the top of the fort is shielded. More particularly, a safe fort that can be easily and rapidly assembled/dismantled is provided.

Although a specific embodiment has been illustrated and described, numerous modifications and variations are still possible without departing from the essence of the invention. The scope of the invention is limited by the accompanying claims.

What is claimed is:

1. A fort comprising:

a wall;

a top cover mounted on top of the wall, the top cover comprising an inverted bowl-like top wall with an opening, the top cover further comprising a peripheral wall extending along a periphery of the top wall, the peripheral wall including a plurality of engaging holes; and a plurality of shooting windows, each said shooting window comprising a plurality of engaging holes, with a plurality of fasteners extending through the engaging holes of each said shooting window and the engaging holes of the top cover, thereby releasably mounting the shooting windows to the peripheral wall of the top cover, and wherein each said shooting window is tubular and conical to allow stacking of the shooting windows.

2. The fort as claimed in claim 1, wherein the peripheral wall comprises a plurality of hook holes for transportation.

3. The fort as claimed in claim 1, wherein the top cover is bowl shaped to allow stacking of the top cover with a similarly constructed top cover.

4. The fort as claimed in claim 1, wherein the each said shooting window comprises a shield on an outer end of an upper side thereof.

* * * * *